United States Patent [19]

Aono et al.

[11] 3,960,120

[45] June 1, 1976

[54] ELECTRONIC FUEL INJECTION CONTROL CIRCUIT FOR AN INTERNAL COMBUSTION ENGINE

[75] Inventors: Shigeo Aono, Seki; Makoto Anzai, Yokosuka, both of Japan

[73] Assignee: Nissan Motor Co., Ltd., Yokohama, Japan

[22] Filed: May 21, 1975

[21] Appl. No.: 579,711

[30] Foreign Application Priority Data

June 21, 1974 Japan ..... 49-70289

[52] U.S. Cl. ..... 123/32 EA; 123/119 R

[51] Int. Cl.[2] ..... F02B 3/00

[58] Field of Search ..... 123/32 EA, 119 R

[56] References Cited

UNITED STATES PATENTS

| | | | |
|---|---|---|---|
| 3,713,427 | 1/1973 | Adler | 123/32 EA |
| 3,817,226 | 6/1974 | Wakamatsu et al. | 123/32 EA |
| 3,858,561 | 1/1975 | Aono | 123/32 EA |
| 3,861,366 | 1/1975 | Masaki et al. | 123/32 EA |
| 3,898,962 | 8/1975 | Honig et al. | 123/32 EA |
| 3,906,205 | 9/1975 | Yoshida et al. | 123/32 EA |
| 3,909,601 | 9/1975 | Yamawaki et al. | 123/32 EA |

*Primary Examiner*—Charles J. Myhre
*Assistant Examiner*—Paul Devinsky

[57] ABSTRACT

Various engine operating conditions are detected by a number of strategically located sensors which convert physically measurable quantities into proportional electrical signals. Such signals are firstly converted into analog signals representative of rectilinearly approximated relation between the input measurable quantities and the amount of fuel necessary for any given engine cycle and secondly converted into a series of command pulses by an exponential converter so that the width of the pulse closely indicates the ideal curvilinear relation between the input quantities and the required fuel quantity.

10 Claims, 12 Drawing Figures

ELECTRONIC FUEL INJECTION CONTROL CIRCUIT FOR AN INTERNAL COMBUSTION ENGINE

The present invention relates generally to an electronic fuel injection system and specifically to an electronic fuel injection circuit for an internal combustion engine.

Electronic fuel injection of internal combustion engines is an accurate means for preparing the proper air-to-fuel mixture for the individual cylinders under all operating conditions. Electronic fuel injection not only improves the engine performance and maximizes fuel economy, but also can curtail objectionalbe emissions generated by the engine. Fuel delivery is regulated via a number of sensors located strategically around the engine. These sensors convert physically measurable quantities, such as engine speed and manifold absolute pressure into proportional electrical signals which are processed by the control system which determines the amount of fuel necessary to ensure the highest torque, best fuel economy and lowest exhaust emissions. The delivery of fuel to the engine is controlled by the width of the command pulse generated by the control circuit. However, the amount of fuel necessary to the engine is nonlinearly variable with the respective measured quantities. The control circuit therefore approximates the input-to-output characteristic for each relationship between the measured quantity and the amount of fuel as nearly as possible in order to precisely determine the width of the command pulse. The use of many circuit elements may enable close approximation of the input-to-output characteristics only at the expense of high cost.

Therefore, an object of the invention is to provide an improved electronic fuel injection control circuit in which economical function generators are used to rectilinearly approximate the desired curvilinear input-to-output characteristics by a plurality of straight-line segments and the rectilinear approximation is corrected by the use of an exponential converter to closely approximate the characteristics.

The invention will be further described with reference to the accompanying drawings, in which:

FIG. 1 is a general circuit diagram of an electronic fuel injection control circuit of the invention;

FIGS. 2*a* and 2*b* are graphs illustrating a characteristic representing the manifold pressure versus the amount of fuel necessary to the engine;

FIGS. 3*a* and 3*b* are graphs illustrating a characteristic representing the engine speed versus the amount of fuel necessary to the engine;

Figure 4:
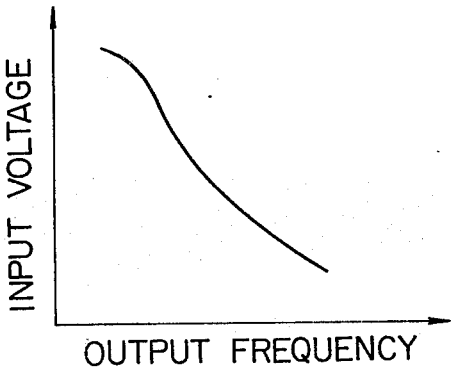
FIG. 4 is a graph illustrating the input-to-output characteristic of an exponential converter employed in the control system.
Figure 7A:
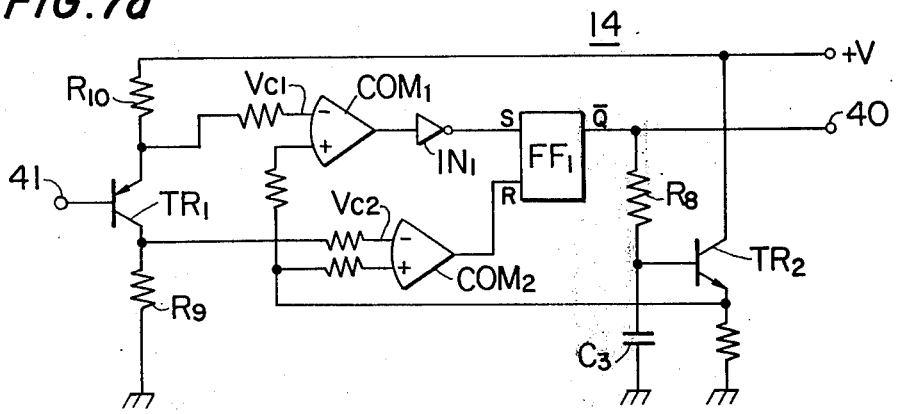
Figure 7B:
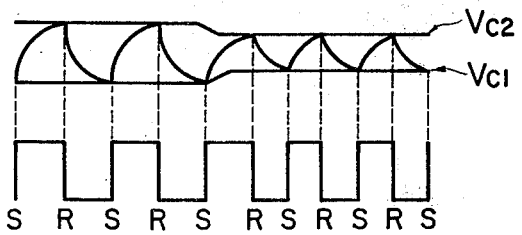

FIG. 7*a* is a circuit diagram of an exponential converter for generating the characteristic of FIG. 4;

FIG. 7*b* shows waveform pulses produced by the circuit of FIG. 7*a;*

Figure 8:
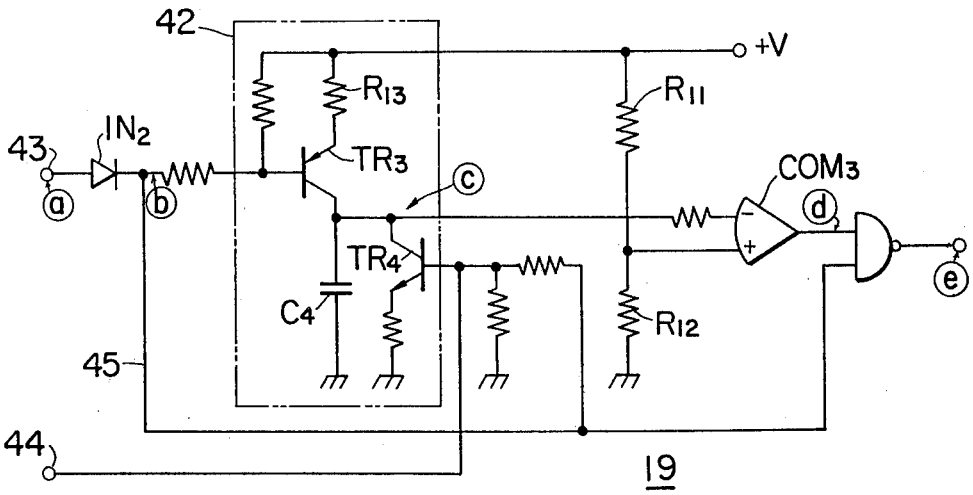
Figure 9:
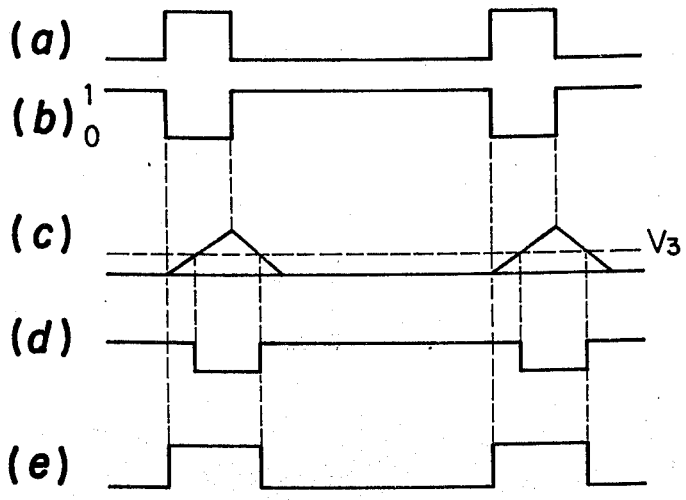

FIG. 8 is a circuit diagram of a multiplier employed in the control system; and FIG. 9 shows the waveforms of signals appearing at various points in the circuit of FIG. 8.

According to one aspect of the present invention it contemplates to approximate the smooth curves relating the various engine operating factors to the quantity of fuel necessary to operate the engine under each particular set of conditions with several straight lines. Such rectilinear approximation of curves allows a simple design of function generators using a resistor network to provide different voltage-to-current slopes and one or more diodes acting as switching elements to change from one slope to another. However, the engine's actual requirement does not have the discontinuities of the rectilinearly approximated lines. Although the use of many diodes and resistors as necessary would approximate the curves more closely, such an approach will result in an increase in the total cost because of the necessity of providing a number of function generators coupled to as many sensors as strategically mounted around the engine. The invention further contemplates the use of an exponential converter or an amplitude-to-frequency converter which converts the input analog signal into digital pulses such that the width of the pulses is exponentially proportional to the input voltage. This eliminates the discontinuities of the rectilinearly approximated curves so that the quantity of fuel necessary under particular a set of conditions for any given cycle is closely related to the ideal engine fuel requirement under the particular conditions.

According to another aspect of the invention, there are provided two groups of function generators coupled to the respective engine condition sensors. The first group of function generators regulates the fuel quantity in a narrow range and the second group of function generators regulates it in a wider range than the first group. The outputs from these groups of function generators are multiplied instead of being summed up to precisely determine the pulse width required for controlling the on-time of the injection valve. This is to avoid the inconvenience in that if they are summed up the narrow range group will be overshadowed by the wider range group and will require that either of the groups is scaled up or down in proportion to one another.

Figure 1:
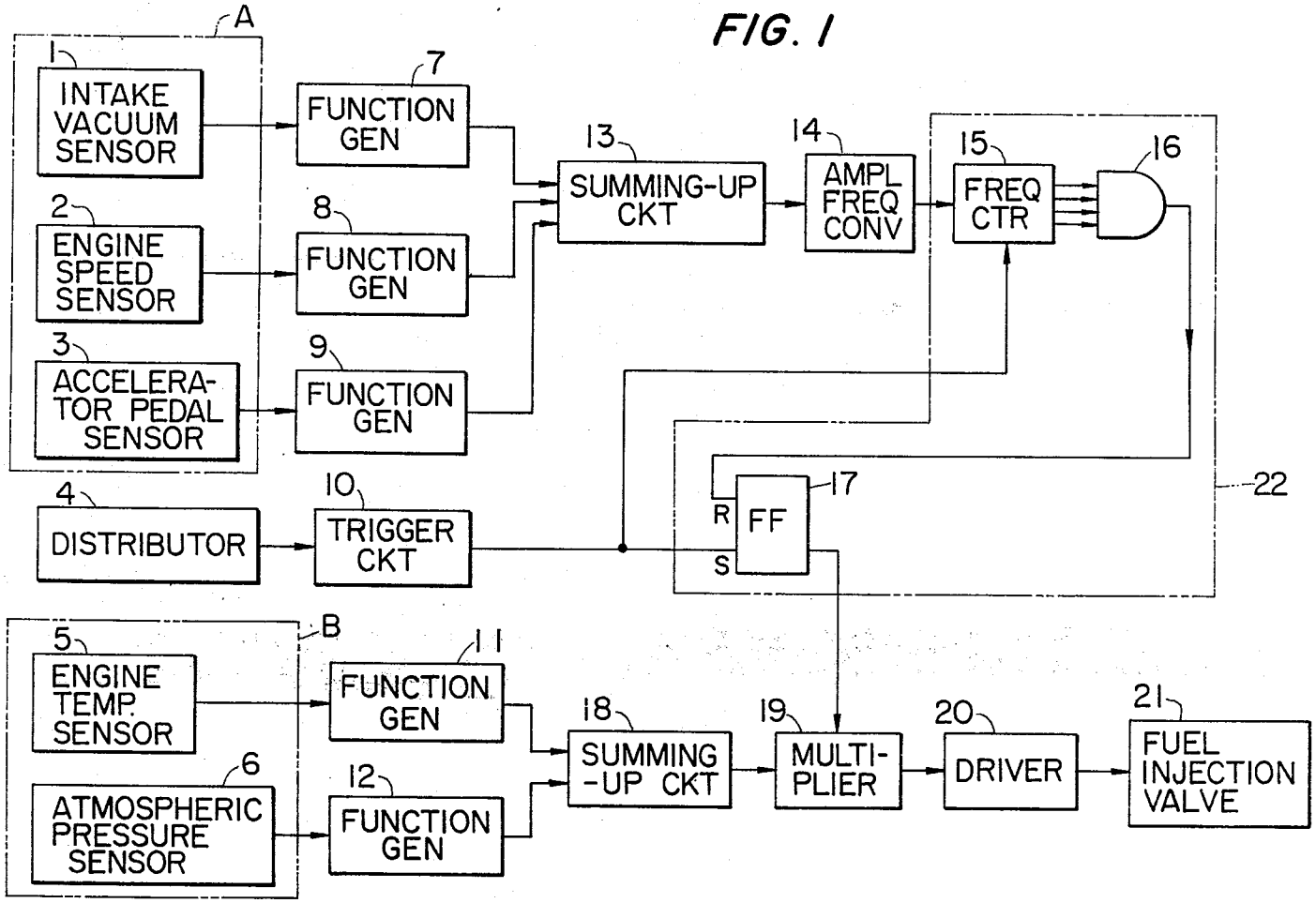
Figure 2A:
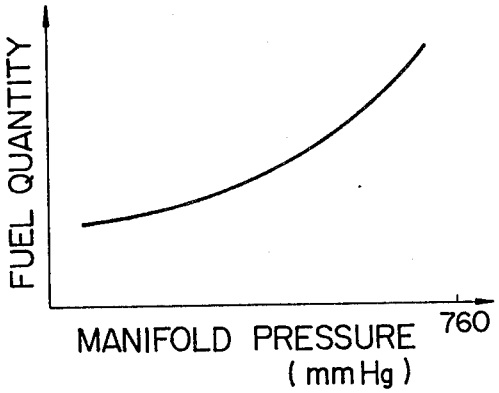

Reference is now made to FIG. 1 in which the general circuit diagram of a fuel supply control system of the invention is shown. A pressure sensor 1 generates an analog signal by sensing the manifold absolute pressure and couples its output to a function generator 7. The manifold absolute pressure versus fuel amount necessary to the engine is shown in FIG. 2*a*. The function generator 7 rectilinearly approximates the curve of FIG. 2*a* by a plurality of straight-line segments so that the output from the sensor 1 is related to the amount of fuel required for the engine. The function generator 7 couples the pressure-related-fuel supply signal to an adder or summing-up circuit 13 where it is added up together with other inputs applied thereto.

Figure 2B:
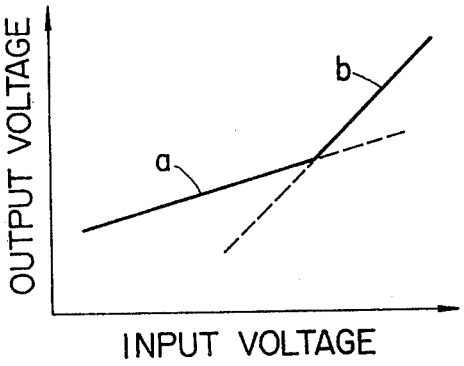
Figure 5:
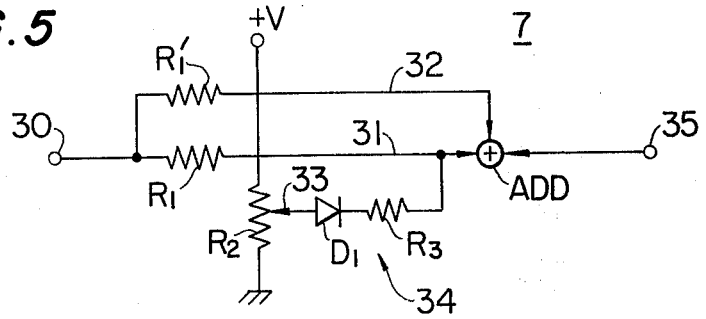
FIG. 5 is a circuit diagram of a function generator used for generating the characteistic of FIG. 2*b;*

One example of function generator 7 is shown in FIG. 5. The output from manifold pressure sensor 1 is applied to input terminal 30 and coupled to an adder ADD through resistors $R_1$ and $R_1'$ connected in parallel paths 31 and 32, respectively. A variable resistor $R_2$ is coupled between a power source +V and ground reference to provide a reference voltage at a tap point 33. A current bypass circuit 34 consisting of a diode $D_1$ and a resistor $R_3$ is coupled between tap point 33 and the input to adder ADD. If the input voltage at terminal 30 is below the reference voltage at point 33, diode $D_1$ is switched to the conductive state to provide a bypass current path through resistors $R_1$ and $R_3$, diode $D_1$, resistor $R_2$ to ground so that the resultant current will rise linearly along line segment *a* in FIG. 2*b*. Upon the input voltage exceeding the reference level, the diode $D_1$ will be switched to the nonconductive state and the bypass circuit 34 will be disconnected and as a result the output current will rise steeply along line segment *b* in FIG. 2*b* at a slope greater than that of line segment *a*. The point of change between the line segments *a* and *b* can be selected anywhere by adjustment of the variable resistor $R_2$ in a manner that approximates the curve of FIG. 2*a*.

The speed of the engine is detected by a sensor 2 which produces a digital signal in accordance with the engine speed and couples it to a function generator 8, which is used to rectilinearly relate the engine speed to the amount of fuel to be supplied to the engine.

Figure 3A:
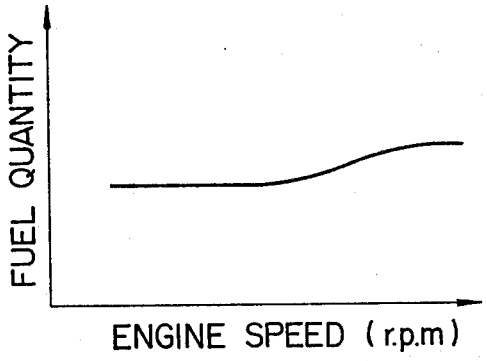
Figure 3B:
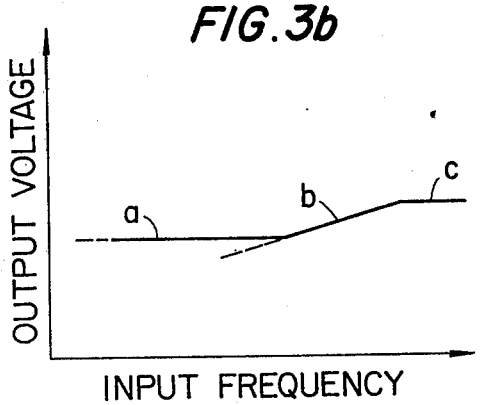
Figure 6:
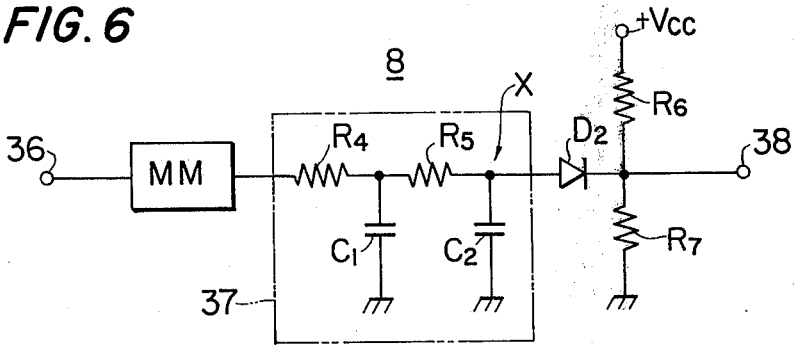
FIG. 6 is a circuit diagram of a function generator used for generating the characteristic of FIG. 3*b;*

One example of function generator 8 is shown in FIG. 6 and comprises a monostable multivibrator MM coupled to the input terminal 36 to receive the digital signal from engine speed sensor 2, an integrating circuit 37 consisting of in series-connected resistors $R_4$ and $R_5$ and a capacitor $C_1$ coupled between a point between the resistors $R_4$ and $R_5$ and ground and a capacitor $C_2$ coupled between the resistor $R_5$ and ground. In series-connected resistors $R_6$ and $R_7$ are coupled between a power source +V and ground. A diode $D_2$ is coupled to a point between the resistor $R_5$ and capacitor $C_2$ and to a point between the resistors $R_6$ and $R_7$. The monostable multivibrator MM produces a pulse of a predetermined duration in response to each of the pulses the repetition rate of which represents the engine speed. The integrating circuit 37 produces an integral output which represents an accumulated voltage in analog form appearing at the input to diode $D_2$. If the voltage at the input to diode $D_2$ is below the potential at a point between the resistors $R_6$ and $R_7$, the diode remains nondonductive, and the voltage at the output terminal 38 then remains constant up to that point where the voltage at the input to diode $D_2$ is equal to the output voltage, shown as line *a* of FIG. 3*b*. When the input voltage exceeds the diode switching level, the output voltage rises in proportion to the input pulse repetition rate shown as line segment *b* of FIG. 3*b* since the conducting diode $D_2$ couples the integrator output to the output terminal 38. The monostable multivibrator MM is so designed that it produces a continuous output when the pulse repetition rate of the input exceeds a predetermined rate. Upon the occurrence of the continuous output, the potential at the output terminal 38 will cease to increase shown as line segment *c* of FIG. 3*b*. These line segments *a*, *b* and *c* of FIG. 3*b* are used to rectilinearly approximate the curve shown in FIG. 3*a* which is representative of the fuel to be supplied to the engine as a function of the engine speed.

The digital signal from engine sensor 2 is thus converted into an analog signal representative of the engine-speed-related fuel supply signal by the function generator 8 which couples it to summing-up circuit 13.

In order to detect the transitory condition of the engine, an accelerator pedal sensor 3 is provided to detect the degree of depression of the pedal by the driver and generates a signal in accordance with the depression and applies it to a function generator 9 which converts the pedal depression to the amount of fuel to be supplied to the engine and applies it to summing-up circuit 13.

It is to be understood that function generator 9 can be designed and constructed in a manner similar to that described above by employment of at least one diode which serves as a switching element and a plurality of parallel-connected resistors.

The analog outputs from the function generators 7, 8 and 9 are added up in the summing-up circuit 13 and applied to an amplitude-to-frequency converter 14 which converts the input voltage to a signal having a frequency which decreases exponentially with the input voltage.

One example of such amplitude-to-frequency converter is shown in FIG. 7. As shown in FIG. 7*a*, the converter 14 comprises a transistor $TR_1$ the base of which is coupled to input terminal 41, the emitter of transistor $TR_1$ being coupled via resistor $R_{10}$ to a power supply +V and the collector of transistor $TR_1$ coupled via resistor $R_9$ to ground reference. A first comparator $COM_1$ is provided having its first input terminal coupled to the emitter of transistor $TR_1$ and its second input coupled to the emitter of a second transistor $TR_2$ which is in an emitter follower configuration. A second comparator $COM_2$ is provided having its first input coupled to the collector of transistor $TR_1$ and its second input connected in common with $COM_1$ to the emitter of transistor $TR_2$. Therefore, potential $VC_2$ at the first input to comparator $COM_2$ is higher than potential $VC_1$ at the first input to comparator $COM_1$. These comparators may be conventional differentiator amplifiers designed to produce positive outputs when the potential at their second inputs is greater than the potential at their first inputs and negative outputs when the potential at their first inputs is greater than at their second inputs. Initially, the potential at the emitter of transistor $TR_2$ is lower than potential $VC_1$, comparator $COM_1$ produces a low level output the polarity of which is reversed by an inverter $IN_1$ and sets a flip-flop $FF_1$. With the Q output of flip-flop going high, transistor $TR_2$ will be switched to the conducting state. Concurrently, a capacitor $C_3$ will be charged so that the voltage thereacross rises exponentially as shown in FIG. 7*b*. The potentials at the second inputs of comparators $COM_1$ and $COM_2$ also increase exponentially until they reach a level equal to the potential $VC_2$ at the input to comparator $COM_2$. Upon the potential at the second input exceeding potential $VC_2$, comparator $COM_2$ produces a high level output which will reset flip-flop $FF_1$. This causes capacitor $C_3$ to discharge exponentially via a resistor $R_8$ until it reaches potential $VC_1$. These processes will be repeated and a train of rectangular pulses are produced at the output terminal 40. When the potential at the input terminal 41 to which the base of transistor $TR_1$ is coupled is varied in accordance with the output from the summing-up circuit 13, the potentials $VC_1$ and $VC_2$ will be caused to vary in accordance therewith so that the pulse repetition rate of the output from terminal 40 will be correspondingly varied. As is seen from FIG. 7*b*, the interval between pulses is determined by the voltage difference between potentials $VC_1$ and $VC_2$ so that the pulse repetition frequency is inversely proportional to and exponentially related to the voltage difference, and hence to the input voltage as shown in FIG. 4. Therefore, the outputs from the function generators 7 to 9 are more closely approximated to the curvature of the respective characteristic curves. The output from the amplitude-frequency converter 14 is coupled to a pulse-forming circuit 22 comprised of a frequency counter 15, an AND gate 16 and a flip-flop 17. Frequency counter 15 may be a conventional binary counter having a plurality of output leads coupled to AND gate 16 which, when a predetermined number is reached, produces a reset signal.

The frequency counter 15 is reset to zero by a clear pulse delivered from a trigger circuit 10 which receives pulses from a conventional distributor 4 of the engine so that the counter 15 is cleared at every engine crankshaft revolution at a predetermined crankshaft angle. This clear pulse is also used to set flip-flop 17. The output from AND gate 16 is used to reset flip-flop 17 so that the output therefrom appears at each crankshaft revolution and the duration of the output pulse represents the resultant values of the various engine operating conditions sensed by sensors 1–3 designated by group A sensor.

In accordance with the invention, other engine operating conditions are sensed by separate sensors 5–6 designated as group B sensors since the quantity of fuel to be supplied to the engine varies widely between the operating parameters sensed by group A and B sensors such as between the manifold pressure and the engine temperature. The group B sensors includes an engine temperature sensor 5 and an atmospheric pressure sensor 6 which may be replaced with a type of sensor which detects the temperature of the intake air so far as it senses the environmental conditions of the engine. A function generator 11 of a similar construction to that previously described is coupled to the engine temperature sensor 5 to generate in response to the output therefrom an analog signal which approximates the fuel supply versus engine temperature characteristic curve by a plurality of straight-line segments. In the same manner a function generator 12 is provided which is coupled to the atmospheric pressure sensor 6 to generate an analog signal responsive to the output therefrom. These analog outputs from the function generators 11 and 12 are added up in a summing-up circuit 18 and applied to a multiplier 19. The multiplier 19 is designed to multiply the digital output representing the fuel supply versus engine conditions sensed by the group A sensors by the analog value representing the fuel supply versus engine operating conditions sensed by the group B sensors.

One example of such multiplication circuit is shown in FIG. 8. The multiplier 19 comprises a a charge-discharge circuit 42, a comparator $COM_3$ having a first input terminal coupled to the output from the charge-discharge circuit 42 and a second terminal coupled to a reference voltage level obtained from a point between resistors $R_{11}$ and $R_{12}$ connected between the power supply +V and ground. The output from flip-flop 17 is coupled to a first input terminal 43 and the output from summing-up circuit 18 is coupled to a second input terminal 44. The signal from flip-flop 17 (FIG. 9*a*) is polarity-reversed by inverter $IN_2$ as shown in FIG. 9*b* and fed into the charge-discharge circuit 42 (FIG. 8) consisting of a transistor $TR_3$, a timing capacitor $C_4$ coupled to the collector of transistor $TR_3$ and a transistor $TR_4$. Transistor $TR_3$ has its base coupled to the inverter $IN_2$ and is switched to the conduction state when the base potential is at zero level to charge the timing capacitor $C_4$ through a resistor $R_{13}$ coupled to the emitter of the transistor $TR_3$. The transistor $TR_3$ serves as a constant current source and the voltage developed across the capacitor $C_4$ will rise linearly as shown in FIG. 9C until the transistor $TR_3$ is switched to the nonconductive state when the inverter's output rises to the high level ("1"). The high level output from the inverter $IN_2$ is applied to the base of transistor $TR_4$ through lead 45 to cause the transistor $TR_4$ to switch to conduct. The charge stored in the capacitor $C_4$ will be discharged through transistor $TR_4$. The signal from the summing-up circuit 18 is applied through terminal 44 to the base of transistor $TR_4$ so that the discharging current falls linearly at a rate inversely proportional to the base potential as shown in FIG. 9C, with the transistor $TR_4$ acting as a constant current source. The voltage developed across the capacitor $C_4$ is applied to the first input terminal to comparator $COM_3$ and compared with the reference potential and produces a low level output when the reference potential is reached as shown in FIG. 9*d*. The output from the comparator $COM_3$ is applied to a NAND gate to which is also applied the output from the inverter $IN_2$. The width of the pulse applied to terminal 43 is therefore caused to vary in accordance with the voltage applied to the terminal 44 and consequently the output pulse from the NAND gate has a width representing the product of the input signals (FIG. 9*e*).

It will be appreciated that since the voltage developed across the capacitor $C_4$ during the charging period is proportional to the pulse length of the input at terminal 43 and to the voltage at input terminal 44 and the time necessary to discharge the stored energy is proportional to the voltage of the stored energy, and the width of the output pulse is proportional to the product of the signals at the input terminals 43 and 44.

The output from the multiplier 19 applied to a driver circuit or amplifier 20 which amplifies the signal to the level necessary to operate the fuel injection valve 21.

What is claimed is:

1. An electronic fuel injection control circuit for an internal combustion engine with means for producing a signal synchronized with the revolution of the engine, comprising:

a plurality of sensing devices for generating signals representative of operating conditions of said engine;

function generating means coupled to each said signal sensing device for rectilinearly relating each operating condition to the amount of fuel to be supplied to said engine;

means coupled to each said function generating means for summing up the outputs therefrom;

an amplitude-to-frequency converter to produce a train of pulses the pulse repetition frequency of which is exponentially inversely proportional to the input amplitude, said converter being coupled to said summing up means to remove the discontinuities of the rectilinear approximation; and a pulse forming circuit including a counter coupled to said converter for counting the pulses therefrom to produce an output when a predetermined number is reached and arranged to be cleared by the synchronous signal, and a flip-flop arranged to be set by the output from said counter and reset by said synchronous signal.

2. An electronic fuel injection control circuit as claimed in claim 1, further comprising additional sensing devices for detecting additional operating conditions of said engine and producing analog signals in accordance therewith, additional function generating means coupled to each said additional sensing device for rectilinearly relating each operating condition to the amount of fuel to be supplied to said engine, additional means for summing up the outputs from said function generating means, and means coupled to said additional summing up means and to said flip-flop for multiplying the outputs therefrom.

3. An electronic fuel injection control circuit as claimed in claim 2, wherein said multiplying means comprises a first input terminal receptive of a train of input pulses, a second input terminal receptive of a voltage input, and a constant current charge-discharge circuit coupled between said first and second input terminals, said circuit being arranged to linearly charge said pulse and linearly discharge the stored pulse during the subsequent interval at a rate proportional to said input voltage.

4. An electronic fuel injection control circuit as claimed in claim 1, wherein said amplitude-to-frequency converter comprises means for setting a first voltage level variable in accordance with a voltage output from said function generating means and a second voltage level higher than said first voltage level and variable in accordance with said voltage output so that the difference between said first and second voltage levels varies in proportion to said voltage output, voltage sensing means to alternately detect said voltage levels, a charge-discharge circuit coupled to said voltage sensing means to repeatedly charge and discharge said voltage difference and a transistor coupled to said charge-discharge circuit to produce an output in the form of pulses.

5. An electronic fuel injection control circuit as claimed in claim 4, wherein said voltage level setting means comprises a second transistor arranged to receive said voltage output on the base thereof and having its emitter resistively coupled to a power source to provide said first voltage level and having its collector resistively coupled to ground to provide said second voltage level, and said voltage sensing means comprises a first comparator for comparing said first voltage level with the voltage at the output from said first transistor, a second comparator for comparing said second voltage level with the output from said first transistor, an inverter coupled to said first comparator to reverse the polarity of the output therefrom, and a flip-flop coupled to said inverter and said second comparator to repeatedly produce an output in accordance with difference between said first and second voltage levels.

6. An electronic fuel injection control circuit as claimed in claim 1, wherein said sensing devices include means for detecting the pressure of the intake manifold of said engine, means for detecting the speed of said engine and means for detecting the depression of the accelerator pedal of a vehicle.

7. An electronic fuel injection control circuit as claimed in claim 2, wherein said additional sensing devices include means for detecting the temperature of said engine and means for detecting the atmospheric pressure.

8. In an electronic fuel injection control circuit for an internal combustion engine having means for producing a signal synchronized with the revolution of the engine, including a plurality of sensing devices for generating signals representative of operating conditions of said engine, and wherein said signals are converted into a form suitable for controlling the supply of fuel to said engine in accordance with said operating conditions, the combination of:

function generating means coupled to each said signal sensing means for rectilinearly relating each operating condition to the amount of fuel to be supplied to said engine;

an amplitude-to-frequency converter to produce a train of pulses the pulse repetition frequency of which is exponentially, inversely proportional to the input amplitude, said converter being coupled to said function generating means to remove the discontinuities of the rectilinear approximation;

a pulse forming circuit including a counter coupled to said converter for counting the pulses therefrom to produce an output when a predetermined number is reached and arranged to be cleared by said synchronous signal and a flip-flop arranged to be set by the output from said counter and reset by said synchronous signal.

9. The combination as claimed in claim 8, wherein said amplitude-to-frequency converter comprises means for setting a first voltage level variable in accordance with an input signal thereto and a second voltage level higher than said first level and variable in accordance with said input signal so that the difference between said first and second voltage levels varies in proportion to said input signal, voltage sensing means to alternately detect said voltage levels, a charge-discharge circuit coupled to said voltage sensing means to repeatedly charge and discharge said voltage difference, and a transistor coupled to said charge-discharge circuit to produce an output in the form of pulses.

10. The combination as claimed in claim 9, wherein said voltage level setting means comprises a second transistor arranged to receive an input signal through the base thereof and having its emitter resistively coupled to a power source to provide said first voltage level and its collector resistively coupled to ground to provide said second voltage level, and said voltage sensing means comprises a first comparator for comparing said first voltage level with the voltage at the output from said first transistor, a second comparator for comparing said second voltage level with the output from said first transistor, an inverter coupled to said first comparator to reverse the polarity of the output therefrom, and a flip-flop coupled to said inverter and to said second comparator to repeatedly produce an output in accordance with the difference between said first and second voltage levels.

* * * * *